United States Patent [19]

Hawkins

[11] 4,097,107

[45] Jun. 27, 1978

[54] INSULATION DISPLACEMENT TERMINAL

[75] Inventor: Harold G. Hawkins, Bristolville, Ohio

[73] Assignee: General Motors Corporation, Detroit, Mich.

[21] Appl. No.: 748,486

[22] Filed: Dec. 8, 1976

[51] Int. Cl.[2] ..... H01R 11/20

[52] U.S. Cl. ..... 339/97 R

[58] Field of Search ..... 339/97–99

[56] References Cited

U.S. PATENT DOCUMENTS

| | | | |
|---|---|---|---|
| 2,989,723 | 6/1961 | Hopkins et al. | 339/213 R |
| 3,824,530 | 7/1974 | Roberts et al. | 339/99 R |
| 3,835,444 | 9/1974 | Plana et al. | 339/98 |
| 3,971,615 | 4/1975 | Hashimoto | 339/98 |

FOREIGN PATENT DOCUMENTS

| | | | |
|---|---|---|---|
| 1,259,992 | 2/1968 | Germany | 339/97 R |

*Primary Examiner*—Joseph H. McGlynn
*Attorney, Agent, or Firm*—F. J. Fodale

[57] ABSTRACT

An insulation displacement terminal has front and back end plate portions interconnected by a central perpendicularly disposed spring portion of hairpin shaped section. The spring portion permits but resists relative movement between the front and back end plate portions. The end plate portions have slots designed to simultaneously scrape a conductor core for good electrical contact and energize the spring portion and then lock the scraped conductor core at their inner closed ends under the bias of the energized spring.

10 Claims, 5 Drawing Figures

INSULATION DISPLACEMENT TERMINAL

This invention relates generally to electrical terminals and more specifically electrical terminals which make electrical contact with an insulated electrical wire by displacing portions of the insulation and engaging the conductor core.

A typical insulation displacement terminal is shown in U.S. Pat. No. 3,824,530 granted to Lincoln Edwin Roberts on July 16, 1974 for "Installation of Electrical Connector or Wire Intermediate the Ends Thereof". The terminal 18 disclosed in the patent illustrates the typical approach to insulation displacement terminals in the use of a plate portion 24 or 26 having a narrow slot 30 or 32 which as an insulated electrical wire is pushed down into it displaces the insulation and engages the conductor core. A drawback of such a "fixed slot" terminal is that the slot is generally sized to accept a specific diameter conductor core thus requiring a different terminal for each size of insulated electrical wire. Another related drawback is that such "fixed slot" terminals are not well suited for stranded conductor cores which may not have a smooth outer surface or hold their shape as well as solid conductor cores.

The object of my invention is to provide an improved insulation displacement terminal which overcomes one or more of the drawbacks enumerated above.

Another object of my invention is to provide an insulation displacement terminal which accommodates various diameter cores.

Another object of my invention is to provide an insulation displacement terminal which is especially suited for insulated electrical wires having stranded conductor cores.

Yet another object is to provide an insulation displacement terminal having relatively movable end plate portions having slots which are designed to urge the conductor core toward the bottom or closed end of the slots under the bias of a spring portion of the terminal.

Yet another object of the invention is to provide an insulation displacement terminal having relatively movable end plate portions having slots which scrape the conductor core for good electrical contact while simultaneously energizing a spring portion of the terminal which subsequently biases the electrical wire against the bottom or closed end of the slots which assures good electrical contact with the scraped conductor core and prevents egress of the electrical wire from the slots.

Figure 1:
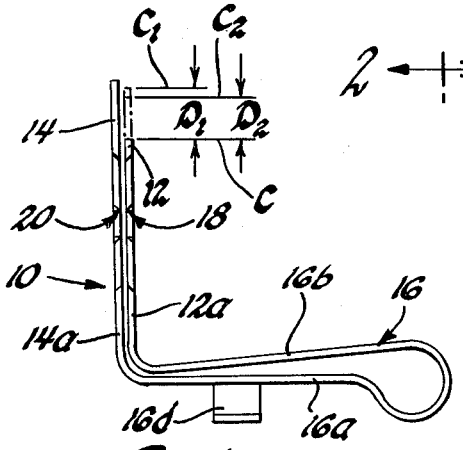
Figure 2:
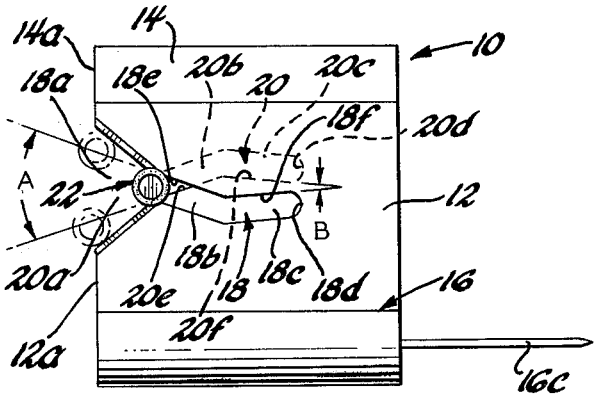
Figure 3:
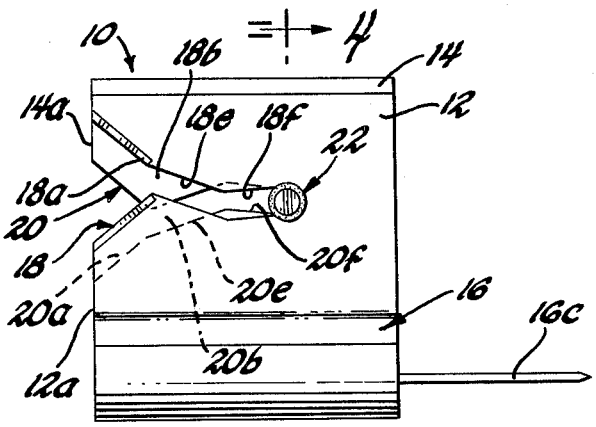
Figure 4:
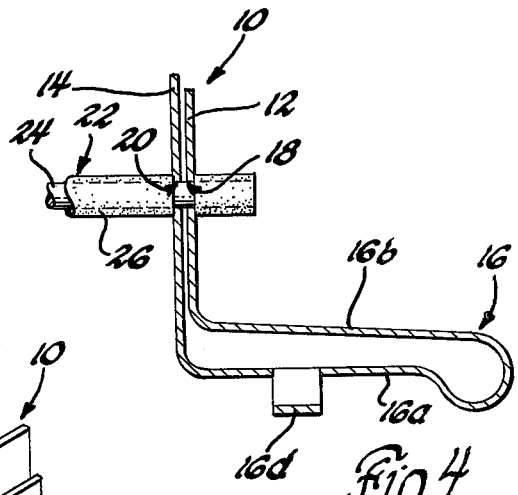
Figure 5:
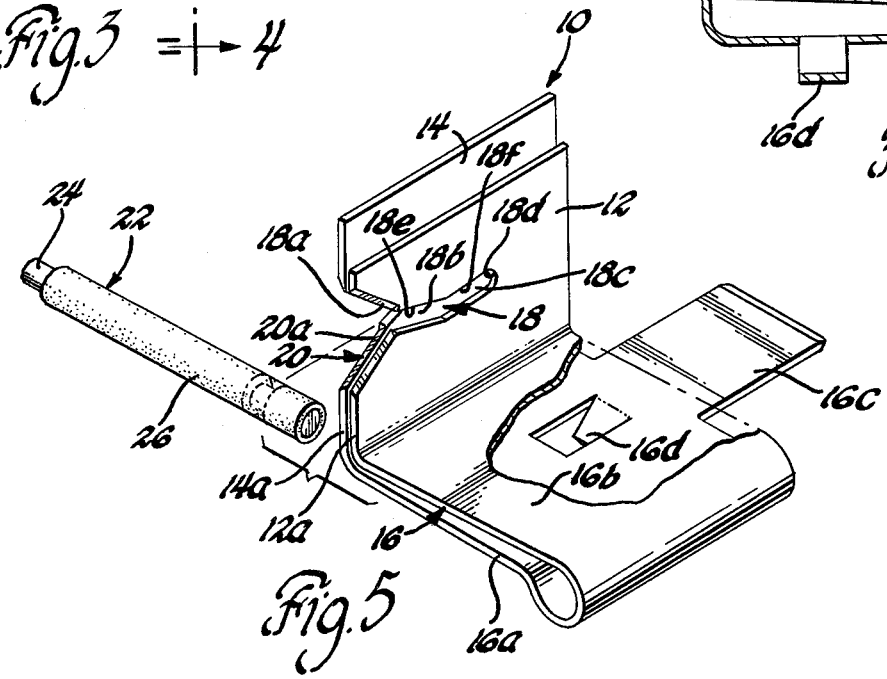

Other objects and features of the invention will become apparent to those skilled in the art as the disclosure is made in the following detailed description of a preferred embodiment of the invention as illustrated in the accompanying sheet of drawing in which:

FIG. 1 is a side view of an insulation displacement terminal in accordance with this invention, FIG. 2 is a front view of the terminal shown in FIG. 1 taken substantially along the line 2—2 of FIG. 1 and looking in the direction of the arrows, FIG. 3 is a front view of the terminal similar to FIG. 2 showing the terminal operatively engaging an insulated electrical wire, FIG. 4 is a section taken substantially along the line 4—4 of FIG. 3 and looking in the direction of the arrows, FIG. 5 is a perspective view of the terminal shown in FIGS. 1 and 2 with a portion thereof broken away to illustrate otherwise hidden detail.

Referring now to the drawing and more particularly to FIG. 5 the terminal 10 comprises a unitary sheet metal body which may be conveniently formed from a strip shaped stamping which is reversely folded upon itself and bent into a double layered L-shaped body. More specifically the terminal 10 comprises a pair of rectangularly shaped end plate portions 12 and 14 juxtaposed one in front of the other in a closely spaced parallel relationship. Then parallel bottom edges of the end plate portions 12 and 14 are interconnected by a central flat spring portion 16 which is of hairpin shaped section and disposed generally perpendicular to the end plate portions 12 and 14. The bottom leg **16*a* of the spring portion 16 is connected to the back end plate portion 14 and the top leg 16*b* is connected to the front end plate portion 12. Consequently the spring portion 16 which is shown in its free unstressed state in FIGS. 1 and 2 permits but resists upward vertical movement of the front plate portion 12 with respect to the back end plate portion 14 from the position shown in FIGS. 1 and 2. The front plate portion 12 moves substantially parallel to the back plate portion 14 for a reasonable distance because of the shape and disposition of the spring portion 16. The bottom leg 16*a* of the spring portion 15 has a coplanar extension which serves as a male electrical contact 16*c* for mating connection with a female contact (not shown) and a central portion which is cut out and bent downwardly at an angle to serve as a lock tab 16*d* for locking the terminal 10** in a connector body cavity (also not shown).

The front and back end plate portions 12 and 14 have slots 18 and 20 respectively which extend laterally, that is, in the same general direction as the parallel bottom edges conneced by the spring portion 16. The slot 18 in the front plate portion 12 comprises a V-shaped open end **18*a* at the free side edge 12*a*; an outer enerizing portion 18*b* which converges toward the bottom edge in a direction toward the right as viewed in FIG. 2 and an inner scissors portion 18*c* which diverges from the bottom edge toward the right and terminates in a closed end 18*d* laterally spaced from the side edge 12*a*. The slot 20 in the back end plate portion 14 comprises a V-shaped open end 20*a* at the free side edge 14*a*, an outer energizing portion 20*b* which diverges away from the bottom edge toward the right as viewed in FIG. 2; and an inner scissors portion 20*c* which converges toward the bottom edge and terminates in a closed end 20*d***.

The terminal is illustrated with the spring portion 16 in a free unstressed state in FIGS. 1, 2 and 5. In this state, the V-shaped open ends **18*a* and 20*a* and the adjacent end portions of the outer energizing portions 18*b* and 20*b* are respectively aligned to simultaneously receive an insulated electrical wire 22 comprising a central conductive core 24 and an outer insulation layer 26. From their aligned end portions, the outer energizing portions 18*b* and 20*b* diverge away from each other and end at a location of maximum vertical displacement of the slots 18 and 20 from which location the inner scissors portions 18*c* and 20*c* commence and thence converge toward the vertically displaced closed ends 18*d* and 20*d***.

The slot portions **18*b*, 18*c*, 20*b* and 20*c* are preferably of substantially constant width approximately equal to the largest diameter of conductor core to be received therein. The terminal however does accommodate a smaller diameter core since it is the relatively movable upper edges 18*e* and 18*f* of the slot 18 forming a V and the lower edges 20***e* and 20*f* of the slot 20 forming an inverted V which are operative to first scrape the conductor core 24 for good electrical contact and then bias the electrical wire 22 against the closed ends 18*d* and 20*d* to make good electrical contact. When spring portion 16 is in the free or unstressed state the upper edge 18*e* of the outer energizing portion 18*b* of the slot 18 in front end plate portion 12 and the lower edge 20*e* of the outer energizing portion 20*b* of the slot 20 in the rear end plate portion 14 define an acute dihedral angle A perpendicular to the end plate portions 12 and 14 as shown in FIG. 2. Similarly the upper edge 18*f* and lower edge 20*f* of the respective inner scissors portions 18*c* and 20*c* form an acute dihedral angle B. The acute dihedral angle A is normally greater than the acute dihedral angle B so that the conductor core 24 is biased into engagement against the closed ends 18*d* and 20*d* under the action of spring portion 16 as shown in FIG. 3.

In operation, the insulated electrical wire 22 is placed in the aligned V-shaped open ends 18*a* and 20*a* of the slots 18 and 20. The edges defining these V-shaped open ends are preferably coined facilitating the piercing of the insulation layer 26 as the insulated electrical wire 22 is moved into the aligned end portions of the energizing portions 18*b* and 20*b* as shown in solid lines in FIG. 2. Further movement of the wire 22 to the right along the edges 18*e* and 20*e* causes vertical upward movement of the front plate portion 12 with respect to rear plate portion 14 against the resistance of the spring portion 16. The movement energizes the spring portion 16 and also causes the edges 18*e* and 20*e* to scrape the conductor core 24 under the bias of the energized spring portion 16.

When the conductor core 24 engages the vertex of the V formed by the edges 18*e* and 18*f* and the vertex of the inverted V formed by the edges 20*e* and 20*f*, the front plate portion 12 has moved up a distance $D_1$ from its original solid line position C to an uppermost portion which is represented by phantom line position $C_1$ of the top portion of the front plate portion 12. This position of the front plate portion 12 is not otherwise shown however it can readily be appreciated from FIG. 2 that the distance $D_1$ is the maximum vertical displacement of the front plate portion 12 and corresponds to the vertical distance between the aforementioned vertices in the free unstressed state of the spring portion 16 plus the diameter of the conductor core 24.

As the conductor core 24 passes the vertices and simultaneously enters the scissors portions 18*c* and 20*c*, the energized spring portion 16 causes the front plate portion 12 to move vertically downward with respect to rear plate portion 14 and the edges 18*f* and 20*f* of the respective scissors portions 18*c* and 20*c* in turn move the conductor core 24 toward the right and eventually bias the electrical wire 22 against the aligned closed ends 18*d* and 20*d* of the slots 18 and 20 as shown in FIG. 3. When the electrical wire is against the closed ends 18*d* and 20*d*, the front plate portion 12 has moved downwardly to the phantom line position $C_2$ shown in FIG. 1 which is at a lesser vertical distance $D_2$ above the original solid line position C. As noted from FIG. 4 which corresponds to the phantom line position $C_2$ shown in FIG. 1, the ends of the spring portion 16 attached to the end plate portions 12 and 14 are further apart than in FIG. 1 since the front end plate portion 12 does not return to its original position. Thus the slots 18 and 20 are configured such that the front plate portion 12 returns toward but does not reach its original position responsive to the electrical wire being received in the scissors portions 18*c* and 20*c* which assures a biasing of the electrical wire 22 against the closed ends 18*d* and 20*d* to make a good electrical contact with the terminal 10.

I wish it to be understood that I do not desire to be limited to the exact details of construction shown and described, for obvious modifications will occur to a person skilled in the art.

What is claimed is:

1. An insulation displacement terminal for piercing the outer insulation of an insulated electrical wire to make contact with the central conductive core comprising:

a unitary sheet metal body having a pair of end plate portions juxtaposed in a closely spaced parallel relationship, a central spring portion interconnecting parallel laterally extending bottom edges of the plate portions and resisting relative movement of the plate portions in a direction transverse to their interconnected bottom edges, each of said end plate portions including a slot which has an outer open end at a free side edge of its respective plate and an inner closed end spaced therefrom, said slots each including an outer energizing portion and an inner scissors portion, each of said outer energizing portions being aligned in part with the other and having an edge angled with respect to an edge of the other for scraping a conductor core of an insulated electrical wire and moving said end plate portions relative to each other against the bias of the spring portion responsive to movement of a conductor core of an insulated electrical wire along said edges toward said inner scissors portion, each of said inner scissors portions having an edge angled with respect to an edge of the other for moving a scraped conductor core of an insulated electrical wire received in said scissors portions from said outer energizing portions along said last mentioned edges and biasing it against the inner closed ends of said slots responsive to relative movement between said end plate portions under the bias of said spring portion.

2. The terminal defined in claim 1 wherein the edges of the outer energizing portions of the slots and the edges of the inner scissors portions each define an acute dihedral angle perpendicular to the end plate portions and wherein the acute dihedral angle defined by the edges of the outer energizing portions is greater than an acute dihedral angle defined by the edges of the inner scissors portions.

3. An insulation displacement terminal for piercing the outer insulation of an insulated electrical wire to make contact with the central conductive core comprising:

a unitary sheet metal body having front and back generally rectangular end plate portions juxtaposed in a closely spaced parallel relationship, a central flat spring portion of hairpin shaped section disposed perpendicularly to the end plate portions, said spring portion having an upper leg and a lower leg connected to respective laterally extending bottom edges of the front and back end plate portions and serving to resist vertical upward movement of the front end plate portion with respect to said back end plate portion, each of said end plate portions including a laterally extending slot which has an outer open end at a free side edge and an inner closed end spaced laterally therefrom, said slots each including an outer energizing portion and an inner scissors portion, each of said outer energizing portions being aligned in part with the other, the outer energizing portion of the slot in the front end plate portion having an upper edge angled with respect to a lower edge of the outer energizing portion of the slot in the back end plate portion for scraping against a conductor core of an insulated electrical wire and moving the front end plate portion vertically upward relative to the back end plate portion against the bias of the spring portion responsive to movement of a conductor core of an insulated electrical wire along said upper and lower edges toward said inner scissors portions, the inner scissors portion of the slot in the front end plate portion having an upper edge angled with respect to a lower edge of the inner scissors portion of the slot in the back end plate portion for moving a scraped conductor core of an insulated electrical wire received in said scissors portions from said outer energizing portions along said last mentioned upper and lower edges into biased engagement against the inner closed ends of said slots responsive to vertical downward movement of said front end plate portion with respect to said back end plate portion under the bias of said spring portion.

4. The terminal as defined in claim 3 wherein the upper edge of the outer energizing portion of the slot in the front end plate portion and the lower edge of the outer energizing portion of the slot in the back end plate portion define an acute dihedral angle perpendicular to the end plate portions which acute dihedral angle is greater than an acute dihedral angle defined by the upper edge of the inner scissors portion of the slot in the front end portion and the lower edge of the inner scissors portion of the slot in the back end plate portion perpendicular to the end plate portions.

5. The terminal defined in claim 3 wherein the upper edges of the outer energizing portion and the inner scissors portion of the slot in the front end plate portion for a V.

6. The terminal as defined in claim 5 wherein the upper edge of the outer energizing portion of the slot in the front end plate portion and the lower edge of the outer energizing portion of the slot in the back end plate portion define an acute dihedral angle perpendicular to the end plate portions which acute dihedral angle is greater than an acute dihedral angle defined by the upper edge of the inner scissors portion of the slot in the front end portion and the lower edge of the inner scissors portion of the slot in the back end plate portion perpendicular to the end plate portions.

7. The terminal as defined in claim 3 wherein the lower edges of the outer energizing portion and the inner scissors portion of the slot in the back end plate portion form an inverted V.

8. The terminal as defined in claim 7 wherein the upper edge of the outer energizing portion of the slot in the front end plate portion and the lower edge of the outer energizing portion of the slot in the back end plate portion define an acute dihedral angle perpendicular to the end plate portions which acute dihedral angle is greater than an acute dihedral angle defined by the upper edge of the inner scissors portion of the slot in the front end portion and the lower edge of the inner scissors portion of the slot in the back end plate portion perpendicular to the end plate portions.

9. The terminal as defined in claim 5 wherein the lower edges of the outer energizing portion and the inner scissors portion of the slot in the back end plate portion form an inverted V.

10. The terminal as defined in claim 9 wherein the upper edge of the outer energizing portion of the slot in the front end plate portion and the lower edge of the outer energizing portion of the slot in the back end plate portion define an acute dihedral angle perpendicular to the end plate portions which acute dihedral angle is greater than an acute dihedral angle defined by the upper edge of the inner scissors portion of the slot in the front end portion and the lower edge of the inner scissors portion of the slot in the back end plate portion perpendicular to the end plate portions.

* * * * *

UNITED STATES PATENT OFFICE

CERTIFICATE OF CORRECTION

Patent No. 4,097,107 Dated June 27, 1978

Inventor(s) Harold G. Hawkins

It is certified that error appears in the above-identified patent and that said Letters Patent are hereby corrected as shown below:

Column 2, line 9, "Then" should read -- The --;

line 24, "15" should read -- 16 --.

Column 3, line 39, "portion" should read -- position --.

Column 4, line 51, "an" should read -- the --.

Column 6, line 2, "for" should read -- form --.

Signed and Sealed this

*Twenty-seventh* Day of *February 1979*

[SEAL]

*Attest:*

RUTH C. MASON
*Attesting Officer*

DONALD W. BANNER
*Commissioner of Patents and Trademarks*